US005876253A

United States Patent [19]

Martucci et al.

[11] Patent Number: 5,876,253

[45] Date of Patent: Mar. 2, 1999

[54] ELECTRICAL CONNECTOR WITH IMPROVED TERMINAL LATCHING SYSTEM

[75] Inventors: Roberto Martucci, Montegrotto T. Padova; Gianni Zuin, Mestrino-Padova, both of Italy

[73] Assignee: Molex Incorporated, Lisle, Ill.

[21] Appl. No.: 806,434

[22] Filed: Feb. 26, 1997

Related U.S. Application Data

[63] Continuation of Ser. No. 590,220, Jan. 23, 1996.

[51] Int. Cl.[6] ..... H01R 13/432

[52] U.S. Cl. ..... 439/748; 439/752.5

[58] Field of Search ..... 439/748, 752.5, 439/744–9, 871–2, 877

[56] References Cited

U.S. PATENT DOCUMENTS 3,697,934 10/1972 Merry ..... 439/748

3,764,960 10/1973 Heimbrock ..... 439/748

*Primary Examiner*—Khiem Nguyen

*Assistant Examiner*—Eugene G. Byrd

*Attorney, Agent, or Firm*—Stacey E. Caldwell

[57] ABSTRACT

An electrical connector includes a terminal having a generally cylindrical mating portion with an open seam extending longitudinally therealong. A flexible latch flange projects transversely from the mating portion on each side of the seam. A dielectric housing has an elongated terminal-receiving passageway for receiving the mating portion of the terminal. An elongated groove communicates with the passageway for receiving the latch flanges projecting from the mating portion. The groove has side walls converging from a wide mouth end of the groove to a narrow latch end thereof. The side walls of the groove are adapted to engage the latch flanges and resiliently compress the mating portion of the terminal. The latch end of the groove has an abruptly enlarged latch section behind which the latch flanges snappingly interengage to lock the terminal in the passageway. The latch flanges project from an outside face of the housing to provide access to the latch flanges, as by an appropriate tool, for unlatching the terminal.

8 Claims, 2 Drawing Sheets

ELECTRICAL CONNECTOR WITH IMPROVED TERMINAL LATCHING SYSTEM

This is a continuation of copending application Ser. No. 08/590,220 filed on Jan. 23, 1996.

FIELD OF THE INVENTION

This invention generally relates to the art of electrical connectors and, particularly, to a latching system or means for holding terminals in passageways of a connector housing.

BACKGROUND OF THE INVENTION

A wide variety of mating electrical connectors employ pairs of interengaging pin and socket terminals for interconnecting a plurality of circuits or wires through the mated connectors. The pin and socket terminals often are called male and female terminals, respectively.

The terminals are mounted in a plurality of terminal-receiving passageways in a dielectric housing of the electrical connector. The terminals generally are elongated and are inserted into the passageways along the longitudinal axes of the terminals. Some form of "interengaging" latches normally are provided to hold the terminals in the passageways against withdrawal therefrom.

Various types of terminal latching systems have consistently presented various problems. For instance, the terminals often are provided with outwardly projecting, cantilevered flexible latch arms which snap behind shoulders within the terminal-receiving passageways of the connector housing. The cantilevered latch arms have a tendency to bend, break and/or snag on other parts. For instance, the latch arms may be bent or collapsed on a reel of interconnected terminals during shipping, prior to assembling the terminals within the connector. In addition, in order to have any significant latching capabilities, the latch arms must be of a sufficient width which often limits current-carrying capacity of the terminals and, in turn, may cause overheating.

In order to avoid those problems associated with such flexible latch arms on the terminals, latch arms have been provided on the connector housing itself. In such an arrangement, the housing normally is molded of plastic material, and the latch arms are molded integrally therewith and extend inwardly into the terminal-receiving passageways from interior housing walls. These latch arms on the housing have limited strength and durability. They also present problems during manufacture, because the molded plastic material must flow down the entire length of the arms. The arms also take up space within the connector housing and the terminal-receiving cavities thereof and therefore may make it difficult to provide adequate insulation between adjacent terminals.

This invention is directed to solving the above problems by providing a simple and reliable latching system for terminals in an electrical connector of the character described.

SUMMARY OF THE INVENTION

An object, therefore, of the invention is to provide a new and improved latching system for holding terminals in passageways of an electrical connector housing.

In the exemplary embodiment of the invention, an electrical connector includes a stamped and formed terminal having a generally cylindrical mating portion with an open seam extending longitudinally therealong. A latch flange projects transversely from the mating portion on each opposite side of the seam. A dielectric housing has generally rigid walls defining an elongated terminal-receiving passageway for receiving the mating portion of the terminal. An elongated groove in the wall communicates with the passageway and receives the latch flanges projecting from the mating portion. The groove has side walls converging from a wide mouth end of the groove to a narrow latch end thereof. The side walls are adapted to resiliently compress the mating portion of the terminal as the side walls guide the latch flanges during insertion of the terminal into the housing. The latch end of the groove has an abruptly enlarged latch section behind which the latch flanges snappingly interengage to lock the terminal in the passageway.

As disclosed herein, the enlarged latch section of the groove includes a latch shoulder on each opposite side of the groove for engagement by the latch flanges on opposite sides of the seam in the mating portion of the terminal. The latch flanges project from an outside face of the housing to provide access to the latch flanges, as by an appropriate tool, for unlatching the terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
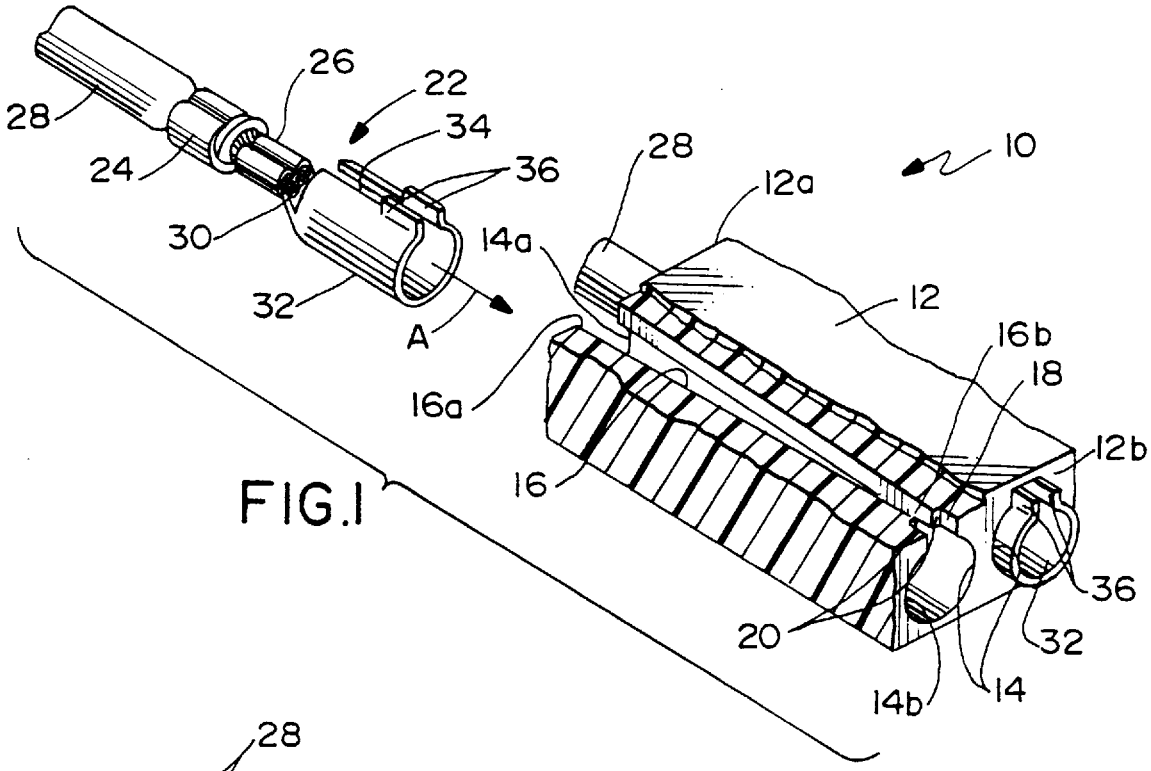
FIG. 1 is a fragmented perspective view, partially cutaway, of an electrical connector with one of two terminals fully received in the connector housing and the other terminal about to be inserted into the housing.

Referring to the drawings in greater detail, and first to FIG. 1, the invention is embodied in an electrical connector, generally designated 10, which includes a dielectric housing 12 defining a plurality of elongated terminal-receiving passageways 14. Only two terminal-receiving passageways 14 are shown in the portion of housing 12 in FIG. 1, but it should be understood that any number of such passageways can be formed in the dielectric housing in substantially any array thereof. Each passageway includes an entry end 14a opening through a rear terminating face 12*a* of housing 12, and a latch end 14*b* opening through a mating face 12*b* of the housing.

An elongated groove 16 communicates with each passageway 14 along the length thereof. The groove converges gradually from a wide mouth end 16*a* adjacent entry end 14*a* of the respective passageway, to a narrow latch end 16*b* adjacent latch end 14*b* of the respective passageway. Latch end 16*b* of each groove 16 has an abruptly enlarged latch section 18 which defines a latch shoulder 20 on each opposite side of the groove at narrow latch end 16*b* of the groove.

A plurality of terminals, generally designated 22, are insertable into passageways 14 in the direction of arrow "A" (FIG. 1). The terminals can be crimped to wires or mounted directly to a printed circuit board (not shown). In the exemplary embodiment shown in the Figures, the terminals are crimped onto insulated wires. Each crimp terminal 22 includes two pairs of crimp arms 24 and 26 for terminating an electrical cable or wire 28. The pair of crimp arms 24 are adapted for crimping onto the outer cladding or covering of the cable to provide strain relief therefore. The pair of crimp arms 26 are adapted for crimping onto the conductive core 30 of the cable to establish conductivity between the terminal and the core.

Each terminal 22 is stamped and formed from conductive sheet metal material and includes a generally cylindrical female mating portion 32 with an open seam 34 longitudinally thereof. The seam is established during the forming of the terminal. A latch flange 36 projects transversely or radially outwardly from mating portion 32 on each opposite side of the seam. The latch flanges are flexible due to their location on opposite sides of the seam, in that the cylindrical mating portion can compress and expand due to the open seam.

In assembly and as stated above, each terminal 32, along with its crimped cable 28, is inserted into its respective passageway 14 in housing 12 in the direction of arrow "A" (FIG. 1). As the terminal is inserted into the passageway, radially outwardly projecting latch flanges 36 project into and move longitudinally of converging groove 16. As the terminal moves toward its fully inserted position, latch flanges 36 are guided by the opposite side walls of groove 16 causing the latch flanges to move toward each other, compressing mating portion 32, as the converging groove gets narrower toward latch end 16*b* of the groove. When latch flanges 36 clear latch shoulders 20 at the latch end of the groove, the latch flanges will "snap" out into engagement behind the latch shoulders and thereby prevent removal of the terminal opposite the direction of arrow "A".

Figure 2:
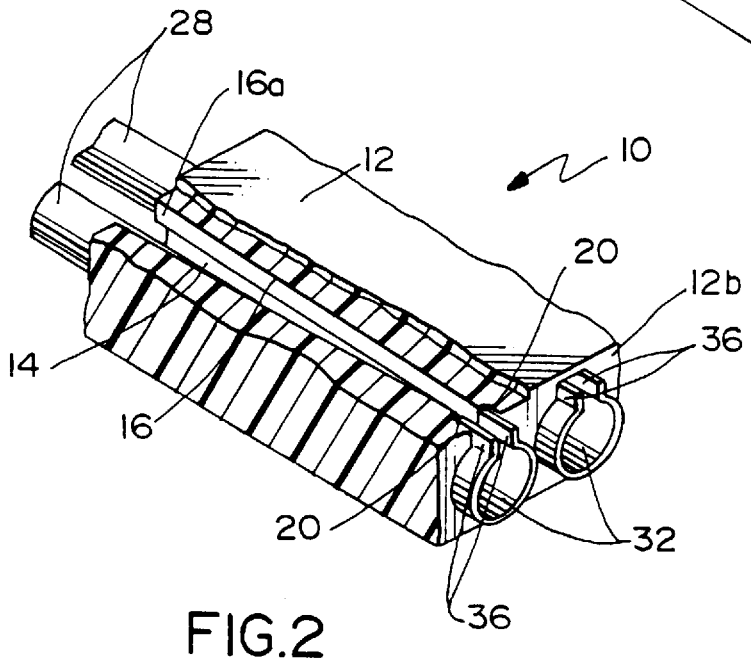
FIG. 2 is a view similar to that of FIG. 1, but with both terminals fully inserted into the housing.

FIG. 2 shows two terminals in their fully inserted positions, and it can be seen clearly how the latch flanges 36 of the left-hand terminal are locked behind latch shoulders 20. It also can be seen in FIG. 2 that mating portions 32 and latch flanges 36 project beyond mating face 12*b* of housing 12. Therefore, a tool, such as a pliers, can be used to grasp latch flanges 32 and squeeze the latch flanges together so that the latch flanges again can clear latch shoulders 20. When the latch flanges are clear of the latch shoulders, the respective terminal can be pulled out of its respective passageway 14 opposite the direction of insertion thereof (i.e. opposite the direction of arrow "A" in FIG. 1).

Figure 3:
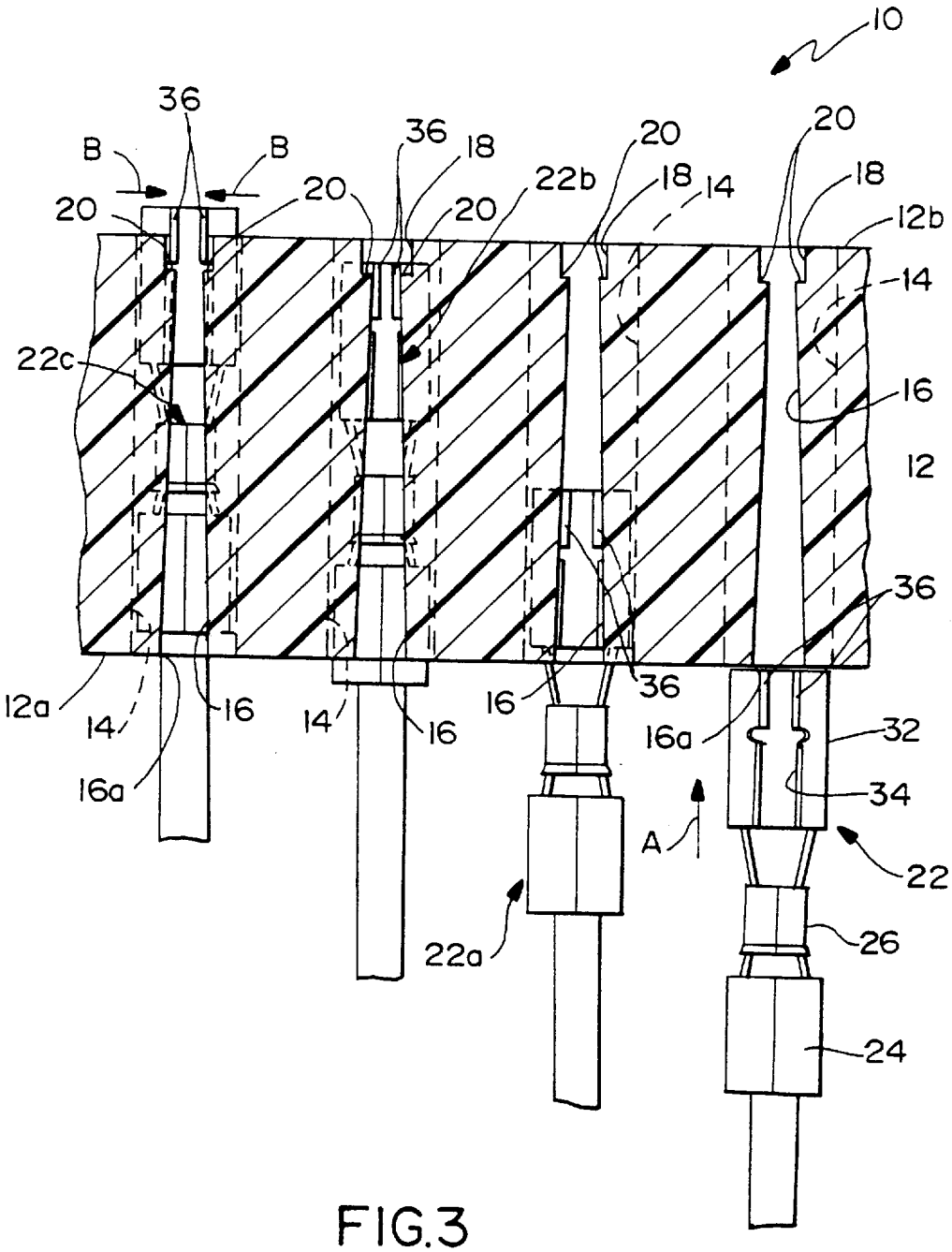
FIG. 3 is a horizontal section, on an enlarged scale, through the camming grooves along four terminal-receiving passageways in the connector housing, and showing sequential positions of insertion of the terminals.

FIG. 3 shows four terminals 22, 22*a*, 22*b* and 22*c* in different sequential positions of insertion into their respective terminal-receiving passageways 14. The right-hand terminal 22 is shown prior to insertion in the direction of arrow "A" into its respective passageway 14 at the right-hand end of housing 12. As the terminal enters the passageway, latch flanges 36 can easily enter groove 16 because the groove, at its mouth end 16*a*, is wider than the spacing of latch flanges 36.

Terminal 22*a* in FIG. 3 has been inserted partially into its passageway 14 to a point whereat latch flanges 36 of the terminal are first engaging the side walls of converging groove 16. However, the latch flanges have not as yet started to compress the mating portion of the terminal.

Terminal 22*b* in FIG. 3 has been inserted to an extent prior to entry of the latch flanges 36 into the abruptly enlarged latch section 18 at the latch end of converging groove 16. In essence, the side walls of the groove have biased the latch flanges toward each other which results in compression of the cylindrical mating portion of the terminal thus building up spring energy therein and tending to bias the latch flanges outwardly to their static condition.

Terminal 22*c* in FIG. 3 is shown in its fully inserted position within its respective passageway 14. It can be seen the latch flanges 36 have snapped back outwardly into enlarged latch section 18, with the latch flanges positioned behind latch shoulders 20. In this fully inserted position, the terminal cannot be removed from its passageway (i.e. opposite the direction of arrow "A") due to the interengagement between latch flanges 36 and latch shoulders 20.

Lastly, FIG. 3 shows how fully inserted terminal 22*c* projects beyond mating face 12*b* of housing 12. This affords access to latch flanges 36 by an appropriate tool, such as a pliers. If desired, the latch flanges can be squeezed toward each other in the direction of arrows "B" until the latch flanges are close enough to each other to clear latch shoulders 20. Once clear of the shoulders, the terminal can be pulled back out of its passageway in a direction opposite the described insertion procedure.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector comprising:

a plurality of stamped and formed sheet metal terminals, each terminal having a generally cylindrical mating portion with an open seam extending longitudinally therealong, the mating portion including a generally cylindrical pin-receiving opening for receiving a mating terminal therethrough such that the axes of the mated terminals are adapted to generally coincide, the terminal further including a flexible latch flange projecting transversely from the mating portion on each opposite side of the seam; and a dielectric housing having generally rigid wall means defining a plurality of generally cylindrical elongated terminal-receiving passageways disposed in a generally parallel, linear array and dimensioned for receiving a corresponding mating portion of one of the terminals the housing further having an elongated groove in the wall means communicating with each passageway for receiving the latch flanges projecting from the mating portion, the groove having side walls converging from a wide mouth end of the groove to a narrow latch end thereof and adapted to engage the latch flanges and resiliently and radially compress the mating portion of the terminal during insertion of the female terminal into the terminal-receiving passageway such that upon compression, the matins portion remains generally cylindrical wherein the latch end of the groove includes an abruptly enlarged latch section into which the latch flanges snapplingly interengage to lock the terminal in the passageway.

2. The electrical connector of claim 1 wherein said enlarged latch section of the groove includes a latch shoulder on each opposite side of the groove for engagement by the latch flanges on opposite sides of said seam.

3. The electrical connector of claim 1 wherein said latch flanges project outside a mating face of the housing to provide access to the latch flanges for unlatching the terminal.

4. The electrical connector of claim 3 wherein said wide mouth end of the groove opens at a terminating face of the housing and the narrow latch end of the groove opens at the mating face of the housing, and said latch flanges project beyond the mating face for access thereto to allow for baising the latch flanges together and unlatching the terminal.

5. An electrical connector comprising:

a dielectric housing having a plurality of elongated, generally cylindrical terminal-receiving passageways extending therethrough and disposed in a generally parallel, linear array, and an elongated groove communicating with each passageway along the length of the groove, the groove converging gradually from a wide mouth end adjacent a terminal entry end of the passageway to a narrow latch end remote from the terminal entry end of the passageway, the latch end of the groove having an abruptly enlarged latch section; and a plurality of stamped and formed female terminals adapted to be inserted longitudinally into a corresponding one of the passageways through the entry end thereof, each of the terminals including a generally cylindrical mating portion extending along a length of the terminal having a pin-receiving opening at one end of the terminal adapted to receive a mating terminal inserted therethrough such that the axes of the mated terminals are adapted to generally coincide, the terminal further including a pair of latch flanges projecting outwardly from the mating portion into said groove and adapted to radially compress the mating portion during insertion of the female terminal into the terminal receiving passageway such that upon compression the mating portion remains generally cylindrical, and wherein the latch flanges are further adapted to latchingly interengage with the latch section of the groove upon complete insertion of the female terminal into the terminal-receiving passageway.

6. The electrical connector of claim 5 wherein the mating portion of said female terminal includes a longitudinally open seam to provide flexibility for the flanges and to allow the mating portion to compress and expand, wherein one of said latch flanges is on each opposite side of the seam.

7. The electrical connector of claim 6 wherein said enlarged latch section of the groove is further characterized by a latch shoulder on each opposite side of the groove for providing a locking surface for the latch flanges.

8. The electrical connector of claim 5 wherein said latch flange projects from an outside face of the housing to provide access to the latch flange for unlatching the female terminal from the latch section of the elongated groove.

* * * * *